US005087543A

United States Patent [19]

Narita et al.

[11] Patent Number: 5,087,543

[45] Date of Patent: Feb. 11, 1992

[54] ELECTROPHOTOGRAPHIC PRINTER

[75] Inventors: Mitsuru Narita; Tatuo Tanaka, both of Matsumoto, Japan

[73] Assignee: Fuji Electric Co., Ltd., Japan

[21] Appl. No.: 673,254

[22] Filed: Mar. 20, 1991

Related U.S. Application Data

[63] Continuation of Ser. No. 566,898, Aug. 13, 1990, abandoned, which is a continuation of Ser. No. 300,424, Jan. 23, 1989, abandoned.

[30] Foreign Application Priority Data

Jan. 21, 1988 [JP] Japan ..... 63-11192
Nov. 16, 1988 [JP] Japan ..... 63-289232

[51] Int. Cl.[5] ..... G03G 15/04

[52] U.S. Cl. ..... 430/66; 355/211; 430/85; 430/126

[58] Field of Search ..... 355/211, 218, 219, 210, 355/214, 216, 221; 430/31, 35, 55, 902, 56–58, 66, 67, 85, 126

[56] References Cited

U.S. PATENT DOCUMENTS 4,413,897 11/1983 Kohyama ..... 355/221
4,529,292 7/1985 Ohseto ..... 355/219
4,607,934 8/1986 Kohyama ..... 355/210

*Primary Examiner*—A. T. Grimley
*Assistant Examiner*—William J. Royer
*Attorney, Agent, or Firm*—Brumbaugh, Graves, Donohue & Raymond

[57] ABSTRACT

An electrophotogrpahic printer having a photoconductor with an $As_{2-x}Se_{3+x}$ $(0<x<0.5)$ overcoat layer and a carrier generation layer comprising a Se-Te alloy containing about 42% by weight of tellurium is provided in which the charge-removing light has a wavelength shorter then 680 nm, and the time interval between the removal of charge and the re-electrification is in excess of 400 msec, thus minimizing the potential drop at the surface of the photoconductor.

1 Claim, 1 Drawing Sheet

ELECTROPHOTOGRAPHIC PRINTER

This application is a continuation of application Ser. No. 07/566,898, filed on Aug. 13, 1990, now abandoned which, in turn, is a continuation application of application Ser. No. 07/300,424 filed Jan. 23, 1989 now abandoned.

BACKGROUND OF THE INVENTION

The present invention relates to an electrophotographic printer, such as an optical printer or digital printer having a carrier generation layer and an overcoat layer thereover. More particularly, the printer utilizes a function-separating type photoconductor in which the carrier generation layer has high sensitivity and high plate wear resistance.

During operation of the printer several steps are repeated in sequence, i.e., electrification of the photoconductor, exposure to light to form an image pattern in the electrified photoconductor, development of the image using toner, transfer of the toner particles to paper, and removal of residual electric charge.

The photoconductor conventionally used in an optical printer, digital copier or the like, consists of a multilayer film comprising an overcoat layer of Se-As alloy containing relatively low percentages of arsenic. A photoconductor of this type can, on the average, produce only one hundred thousand printed sheets or less before the image quality begins to deteriorate. One of the present inventors has developed a photoconductor whose overcoat layer consists of $As_{2-x}Se_{3+x}$, where $0 \leqq x \leqq 0.5$. This photoconductor has improved physical properties, especially improved hardness, and thus exhibits greatly improved plate wear resistance. An overcoat layer of this type has been described in commonly owned U.S. patent application Ser. Nos. 192,470 and 192,471, both filed May 10, 1988, incorporated herein by reference.

Unfortunately, the provision of the overcoat layer having the composition given by As lowers the surface potential and produces clouded images when used in conventional printers. Further, the potential contrast decreases, deteriorating the gradation and impairing the print quality.

It is thus an object of the present invention to provide a printer employing a function-separating type photoconductor having an $As_{2-x}Se_{3+x}$ overcoat layer which is free of the foregoing difficulties.

It is a further object to provide such a printer which suppresses decrease in the potential created by electrification.

SUMMARY OF THE INVENTION

The above objects are achieved in accordance with the teachings of the invention by an electrophotographic printer in which the light illuminating the photoconductor for the removal of electric charge has a wavelength shorter than 680 nm, preferably in the range of 500 to 680 nm. It is also desired that the time interval between the illumination of light for removal of charge and re-electrification be more than 400 msec. Thus, the printer of the invention comprises a photoconductor comprising a conductive substrate, a carrier transport layer formed on the substrate, a carrier generation layer formed on the carrier transport layer, and an overcoat layer formed on the carrier generation layer, said overcoat layer being of $As_{2-x}Se_{3+x}$, where x lies in the range from 0 to 0.5; means for electrifying the photoconductor; means for exposing the electrified photoconductor to create an image thereon; means for applying toner to the exposed photoconductor; means for transferring toner to a surface such as paper, and means for illuminating the photoconductor after transfer of the toner to remove electrical charge from the photoconductor, wherein the means for illuminating the photoconductor provides illumination at a wave length of less than 680 nm.

DETAILED DESCRIPTION OF THE INVENTION

A function-separating type photoconductor having high sensitivity and high plate wear resistance was fabricated in the manner described below. A base was made of a aluminum tube having a diameter of 80 mm. The tube was machined and cleaned and mounted to the shaft of an evaporation apparatus. The temperature of the base was kept at approximately 190° C., and the pressure was then reduced to $1 \times 10^{-5}$ torr. Subsequently, an evaporation source containing an As alloy was heated to about 900° C. to form a carrier transport layer approximately 60 μm thick by deposition. A carrier generation layer, an electron injection-suppressing layer, and an overcoat layer were successively formed by flash evaporation. The carrier generation layer was made from a alloy comprising 42% by weight of tellurium. The electron injection-suppressing layer was made from a SeAs alloy comprising 4% by weight of As. The overcoat layer was made from a Se-As alloy comprising 36% by weight of As. These layers had thicknesses of about 0.2 μm, 2 μm, and 3 μm respectively. During the flash evaporation, the temperature of the shaft was 60° C., the pressure was $1 \times 10^5$ torr, and the temperature of the evaporation source was 400° C.

The photoconductor fabricated in this way was rotated at a peripheral velocity of 120 mm/sec. It was electrically charged by a voltage of 800 V. It was then exposed to light of a wavelength of 780 nm at 1.5 $\mu J/cm^2$. To remove the charge, the photoconductor was illuminated with light of a wavelength of 450 to 700 nm at 15 $\mu J/cm^2$ at a time which preceded the next electrical charging by 0.6 second. The fatigue characteristics were then evaluated.

Figure 1:
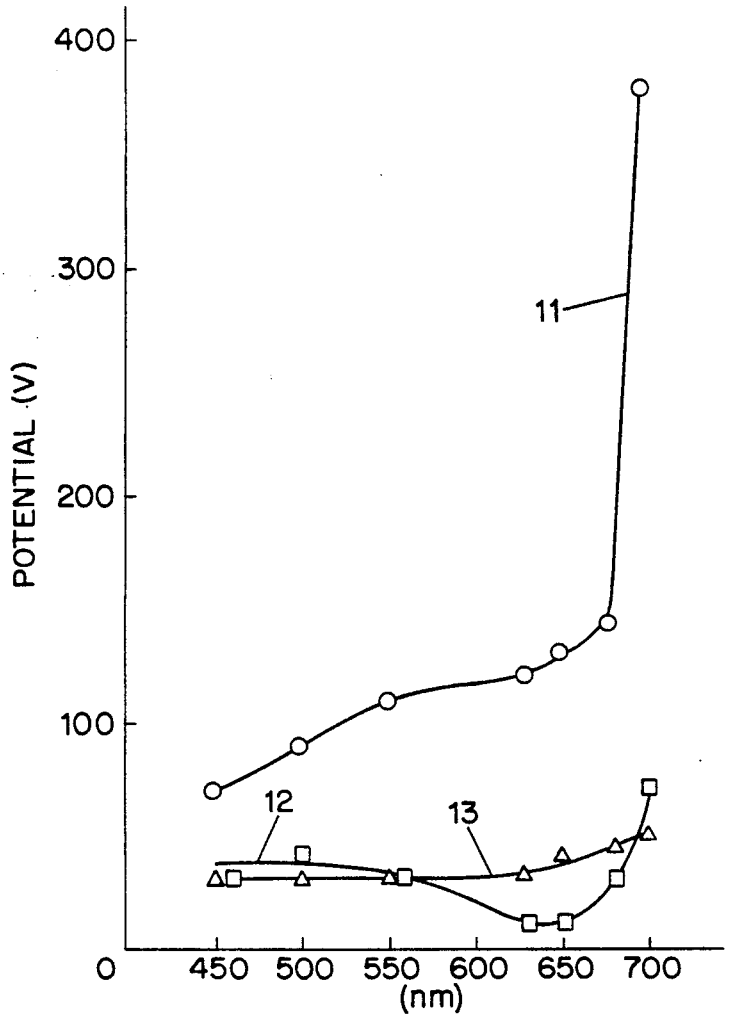
FIG. 1 is a graph showing the relation of the potential fatigue characteristics of a photoconductor to the wavelength of charge-removing light.

In FIG. 1, the potential drop, the memory potential, and the residual potential are indicated by lines 11, 12, 13, respectively. The memory potential is the difference between the potential at the exposed portions and the potential at the unexposed dark portions. As can be seen from the graph, when the wavelength of the charge-removing light is longer than 680 nm, the potential drop increases by a factor of about 4. Also, the memory potential increases. When characters were actually printed with an electrophotographic printer and charge-removing light of 700 nm was used, white paper was clouded and turned black. When the wavelength was shorter than 680 nm, no excess toner adhered, and characters were printed with good print quality.

Figure 2:
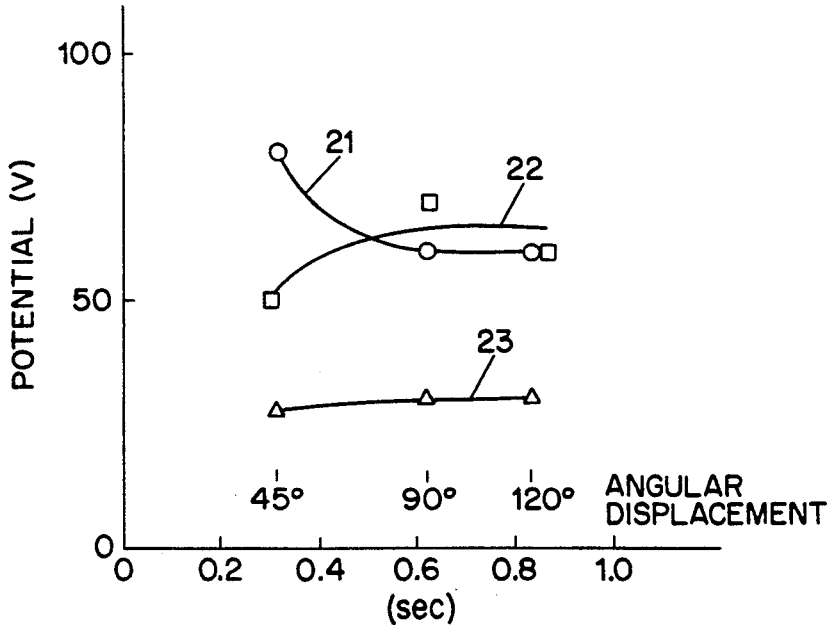
FIG. 2 is a graph showing the relation of the potential fatigue characteristics of a photoconductor to the time interval between removal of charge and electrification

In a second run, the wavelength of the charge-removing light was maintained at 550 nm. The amount of light for removing electric charge was 1.5 $\mu J/cm^2$. Except for these points, the conditions were the same as those used in the case exemplified by FIG. 1. The time interval between the removal of charge and the re-electrification was varied to evaluate the relaxation characteristics. The results are indicated in FIG. 2, where the potential drop, the memory potential, and the residual potential are indicated by lines 21, 22, 23, respectively. It can be seen that at these time interval decreases that the charge drop increases, and that the charge drop increases greatly when the interval becomes less than 300 msec.

If the wavelength of the charge-removing light is made shorter than 450 nm, the potential drop is unlikely to increase conspicuously at normal temperature. However, light sources emitting light of wavelengths shorter than the visible range, i.e., shorter than 380 nm, are expensive. At a temperature of 5° C., the potential drop will increase unless charge-removing light of a wavelength of 500 to 680 nm is used.

While not intending to be limited to any specific theory, the sharp dependency of charge removal on the illuminating wave length can be rationalized in view of the differences in spectral sensitivity between the overcoat layer and the carrier generation layer. When the function-separating type photoconductor having high sensitivity and high plate wear resistance used in the invention is subjected to a positive electric field and exposed to light, the sensitivity varies with wavelength, and the spectral sensitivity of the overcoat layer shows a curve which intersects with the curve drawn by the spectral sensitivity of the carrier generation layer. Stated another way, at wavelengths shorter than 600 nm, carriers are produced in the overcoat layer. At wavelengths longer than 680 nm, carriers are generated in the carrier generation layer. In an electrophotographic process, illumination of the photoconductor with light is needed for the exposure step and removal of charge. During the exposure step, carriers move very easily because the electric field is applied across the film. During the removal of charge, only a small electric field is applied to the exposed area and, therefore, if the photoconductor is illuminated with light of a long wavelength, carriers are produced in the carrier generation layer. The carriers, especially those having a negative charge, tend to remain either at the interface between the overcoat layer and the carrier generation layer, or in the carrier generation layer. In the next process, electrification, the remaining carriers are canceled out by the positive electric charge. As a result, the surface potential drops. Because of this mechanism, the wavelength of light for removing charge is set less then 680 nm so as to minimize negative space charge. Consequently, the drop in the potential created by electrification is suppressed.

We claim:

1. A method for reproducing successive images using an electrophotographic printer comprising a photoconductor, the photoconductor comprising, in sequence, a conductive substrate; a carrier transport layer; a carrier generation layer comprising a Selenium-Tellurium alloy containing about 42% by weight of Tellurium; and an overcoat layer comprising $As_{2-x}Se_{3+x}$, wherein $0 \leqq x \leqq 0.5$, comprising in successive cycles the steps of (a) electrifying the photoconductor;

(b) exposing the electrified photoconductor to create an image thereon;

(c) applying toner to the exposed photoconductor;

(d) transferring the toner to a substrate; and (e) illuminating the photoconductor with light having a wavelength of from 500 to 680 nm to remove residual electrical charge from the photoconductor, wherein at least 400 msec elapses after the removal of charge before a successive electrification.

* * * * *